US006983609B2

(12) United States Patent
Kim et al.

(10) Patent No.: US 6,983,609 B2
(45) Date of Patent: Jan. 10, 2006

(54) HEAT DRIVEN ACOUSTIC ORIFICE TYPE PULSE TUBE CRYOCOOLER

(75) Inventors: Ig Saeng Kim, Cheonan-si (KR); Chun Dong Kim, Gunpo-si (KR); Chang Ho Lee, Gunpo-si (KR); Kyun Seok Kim, Suwon-si (KR); Do Hyung Kim, Anyang-si (KR)

(73) Assignee: LS Cable LTD, Seoul (KR)

( * ) Notice: Subject to any disclaimer, the term of this patent is extended or adjusted under 35 U.S.C. 154(b) by 249 days.

(21) Appl. No.: 10/643,239

(22) Filed: Aug. 18, 2003

(65) Prior Publication Data

US 2005/0022540 A1 Feb. 3, 2005

(30) Foreign Application Priority Data

Aug. 16, 2002 (KR) ..... 10-2002-0048381

(51) Int. Cl.
*F25B 9/00* (2006.01)

(52) U.S. Cl. ..... 62/6

(58) Field of Classification Search ..... 62/6
See application file for complete search history.

(56) References Cited

U.S. PATENT DOCUMENTS

| | | | | |
|---|---|---|---|---|
| 4,858,441 | A * | 8/1989 | Wheatley et al. | 62/6 |
| 5,095,700 | A * | 3/1992 | Bolger | 60/517 |
| 6,622,491 | B2 * | 9/2003 | Hofmann | 62/6 |
| 6,637,211 | B1 * | 10/2003 | Swift et al. | 62/6 |
| 6,658,862 | B2 * | 12/2003 | Swift et al. | 62/6 |
| 6,868,673 | B2 * | 3/2005 | Weiland et al. | 60/698 |

* cited by examiner

*Primary Examiner*—William C. Doerrler
(74) *Attorney, Agent, or Firm*—Vidas, Arrett&Steinkraus PA

(57) ABSTRACT

A heat driven acoustic type pulse tube cryocooler has metal knit installed within a driving section cooling a driving gas of an application device using a principle of high temperature superconductivity, and then homogeneously heats the driving gas by way of premixed combustion so that the driving gas generates an acoustic having a predetermined frequency. The orifice installed within a reservoir controls the amount of the driving gas running between the cold reservoir and the pulse tube to constantly maintain a pressure of the cold reservoir. Therefore, the driving gas repeats the process of the compression and expansion centering around the pulse tube, thereby cooling the application device.

11 Claims, 6 Drawing Sheets

HEAT DRIVEN ACOUSTIC ORIFICE TYPE PULSE TUBE CRYOCOOLER

BACKGROUND OF THE INVENTION

1. Field of the Invention

This invention relates to a cryocooler cooling a superconducting material using an inert gas, and more particularly relates to a heat driven acoustic orifice type pulse tube cryocooler for installing metal knit within a driving section cooling a driving gas of an application device using a principle of high temperature superconductivity, and then homogeneously heating the driving gas by way of premixed combustion.

2. Description of the Background Art

Generally, a cryocooler is applied to a field of infrared rays sensor cooling, a field of cryooperating and MRI, a field of electronic equipments such as RF filter for mobile communication, and a filed of a superconductivity electric power application device, which, for example, are driven at about 77K (−196° C.). The temperature at about 77K (−196° C.) means a cooling temperature of high temperature superconducting material using a liquified nitrogen gas. The cyrocooler cooling the superconducting material is classified as Stirling cryocooler, Joule-Thomson cryocooler, Gifford-McMahon cryocooler, and Pulse Tube cryocooler, depending upon a thermodynamic cycle.

The Gifford-McMahon cryocooler has some problems that, since each of a high temperature part and a low temperature part is provided with one or more driven part, operating efficiency is low, cooling capacity is small, and a maintenance and repair cost is very high.

FIG. 1 is a constitutional view for explaining a operation principle of the prior Stirling cryocooler. The cryocooler consists of a compression space 1*a* and a expansion space 1*b* which each volume of operating gas thereof is changed by movement of a piston 1*c*, a hot heat exchanger 5*a*, a cold heat exchanger 5*b*, and a regenerator 3.

The operational principle of the Stirling cryocooler will be give herein below.

To begin, if the piston 1*c* of the compression space 1*a* and the piston 1*d* of the expansion space 1*d* are moved from left to right on the basis of the drawing with constantly keeping the distance between them, an operating gas within the compression space 1*a* is compressed. At this time, a temperature of the operating gas rises up to $T_H+dT_H$, wherein $T_H$ is a temperature of the hot heat exchanger 5*a*, and $dT_H$ is a predetermined increased temperature. (S10~S20)

If the piston 1*c* is moved from left to right continuously with keeping a constant pressure, a heat of the operating gas within the compressing space 1*a* having comparatively a higher temperature than that of the wall surface of the hot heat exchanger 5*a* is emitted to the outside via the hot heat exchanger 5*a*. (S20~S30)

Simultaneously, the heat of the operating gas is transferred to an inner matrix of the regenerator 3 via the hot heat exchanger 5*a*. Then, the heat from the matrix of the regenerator 3 is transferred to the cold heat exchanger 5*b*, thereby the cold heat exchanger 5*b* has a higher temperature Tc than the prior temperature. Then, the temperature Tc of the cold heat exchanger 5*b* changes the temperature of the expansion space 1*b*. The temperature of the operating gas within the expansion space 1*b* into which the heat of the comparatively higher temperature is input becomes immediately higher, and the operating gas is expanded. At this time, since the piston 1*d* is moved according to thermal expansion of the operating gas within the expansion space 1*b*, the temperature within the expansion space 1*b* becomes Tc-dTc, wherein Tc is a temperature of the cold heat exchanger 5*b*, and dTc is a predetermined decreased temperature. (S30~S40)

Meanwhile, if the piston 1*c* of the compression space 1*a* and the piston 1*d* of the expansion space 1*d* are moved from right to left on the basis of the drawing with constantly keeping the distance between them, an operating gas is compressed, and thereby the piston 1*d* is moved from right to left on the basis of the drawing, and simultaneously the operating gas receives heat from the outside, since the temperature of the operating gas within the expansion space 1*b* becomes relatively lower than that of the cold heat exchanger 5*b*. (S4~S10)

Then, the operating gas within the compressing space 1*a* receives a predetermined heat from the hot heat exchanger 5*a* receiving heat from the matrix of the regenerator 3 and having a higher temperature, and has a temperature $T_H$ of the hot heat exchanger 5*a*.

Here, a heat transfer quantity that the operating gas receives from the regenerator 3 during the steps S40 to S10 is equal to a heat transfer quantity that the operating gas of the compressing space transfers to the regenerator 3 during S20 to S30. Thus, a sum of the heat transfer quantity that the regenerator 3 gives and takes every cycle is numerically "0".

Accordingly, the Stirling cryocooler carrying out a thermal dynamic cycle in regular sequence of S10, S20, S30, S40, and S10 may have a cold effect receiving heat from the low temperature part and emitting heat to the high temperature part.

However, the Stirling cryocooler has a complex structure, since each of a high temperature part and a low temperature part thereof is provided with an additional driving part. Further, the operation reliability is considerably lower due to friction between a sealing member of displacement apparatus such as a piston and a cylinder at low temperature in case of being driven for a long time The Pulse Tube cryocooler, which is transformed from the Stirling cryocooler, is classified as a basic type, an orifice type, and a double inlet type. Further, it is classified as a resonance tube type, 2 valve-type, 4 valve-type and a mixed type according to a structure for a freezing temperature and a freezing capacity.

FIG. 2 is a constitutional view of the prior orifice type pulse tube cyrocooler. According to this type of cyrocooler, after a gas having a predetermined temperature is periodically poured into a tube having a closed end, the cyrocooler is operated according to the change of pressure of a poured gas. In case of having a little turbulent current in the gas flow, it uses a heat pumping effect enabling to obtain very high temperature gradient.

This orifice type pulse tube cyrocooler is consisted of a compressing section 2*a*, an aftercooler 5*c* subsequently connected to the compressing section 2*a*, a regenerator 3-1, a pulse tube 7*a*, a diffuser 7*b*, a cold gas reservoir 7*d*, and an orifice 7*c* installed between the diffuser 7*b* and the cold gas reservoir 7*d*.

Here, the compressing section 2*a* is changed into a expanding section according to its motion, and it is provided with a reciprocating piston 2*c* within the inside. Here, it is assumed that the pulse tube 7*a* have a virtual gas piston.

The comparison with the orifice type pulse cryocooler and the Stirling cryocooler is as follows.

The combination structure of the pulse tube 7*a*, a hot heat exchanger 5*a* and the cold gas reservoir 7*d* corresponds to the expansion space 1*b* of the Stirling cryocooler.

Whereas the piston 1*c* of the compressing space 1*a* and the piston 1*d* of the expansion space 1*b* in the Stirling cryocooler is moved in simultaneous phase, the virtual gas piston within the pulse tube 7*a* of the orifice type pulse tube cryocooler is moved in the same phase as the piston 2*c* of the compressing section 2*a* by the cold gas reservoir 7*d*.

Therefore, the phase difference (generated from the relationship of pressure and mass flow quantity within the pulse tube) between the piston 2*c* of the compressing section 2*a* and the virtual gas piston of the pulse tube is generated between the pulse tube 7*a* and the cold gas reservoir 7*d*.

The phase difference generated from the orifice type pulse tube cryocooler is smaller than the phase difference generated from the piston 1*c* of the expansion space 1*b* of the Stirling cryocooler. Therefore, the cooling effect of the orifice type pulse tube cryocooler is comparatively higher. However, the orifice type pulse tube cryocooler requires more mass flow quantity per cold capacity than the Stirling cryocooler as to the amplitude of pressure change.

Meanwhile, whereas the Stirling cryocooler requires two of more driver such as the compressing space 1*a* and the expansion space 1*b*, the pulse tube cryocooler is provided with only one driver. Therefore, the orifice type pulse tube cryocooler has a more simple structure and is inexpensive for the maintenance and repair cost even an operation for a long time in comparison with the Stirling cryocooler, but still has a problem that the vibration occurs.

FIG. 3 is a constitutional view of the prior heat driven acoustic pulse tube cryocooler. This crycooler is consisted of a driving gas reservoir 9*a*, an electric heater 9*b* subsequently connected to the driving gas reservoir 9*a*, a cylindrical tube 9*c*, a heat-acoustic driver 9*d*, a drive stack 9*e*, a cold stack tube 9*f*, and a pulse tube 7*e*. Here, the other side of pulse tube 7*e* is provided with a diffuser 7*b* and a cold gas reservoir 7*g*.

The operation of this cryocooler will be given herein below.

If an electrical heating source of the electric heater 9*b* generates a pressure pulse of a driving gas reserved in the driving gas reservoir 9*a*, the pressure pulse then adiabatically compresses and expands the gas. Thereafter, the temperature of the gas is changed, and then heat corresponding to the temperature of the gas is transferred to the drive stack 9*e* and the cold stack tube 9*f*. As such a result, the cryocooler is operated.

Here, the heat transferred to the pulse tube 7*e* is exchange in the pulse tube 7*e* due to a circulation of a coolant within the pulse tube 7*e*, and thus the heat is emitted from the pulse tube 7*e* to the outside.

However, this type of cyrocooler has a limited cooling capacity due to a limitation of capacity of the electrical heat source, since a very low temperature is realized by changing the electrical heat source into the acoustic energy.

BRIEF SUMMARY OF THE INVENTION

A first object of the invention is to provide a heat driven acoustic orifice type pulse tube cryocooler for having a combustion structure heating homogeneously an operating gas using a metal knit woven with metal fiber.

A second object of the invention is to provide a heat driven acoustic orifice type pulse tube cryocooler for having a combustion structure heating homogeneously an operating gas using a metal knit woven with metal fiber and overcoming vibration, noise, reliability deterioration, and low capacity generated from a heat driven acoustic process.

A third object of the invention is to provide a heat driven acoustic orifice type pulse tube cryocooler for having a combustion structure heating homogeneously an operating gas using a metal knit woven with metal fiber in order to be utilized as a cryocooler for cooling a superconductivity application device requiring a small capacity and for a superconductivity electronic equipments such as a field of infrared rays sensor cooling, a field of cryooperating and MRI, a field of electronic equipments such as RF filter for mobile communication, and a filed of a superconductivity electric power application device.

To accomplish the above objects, the inventive cryocooler comprises a driver 10 generating a flame radiating heat having a predetermined temperature, homogeneously heating a driving gas, and adiabatically compressing the driving gas so that the driving gas generates an acoustic having a predetermined frequency; a regenerator 20 receiving the driving gas output from the driver, and cooling the driving gas; a pulse tube 40 receiving the cold driving gas output from the generator, adiabatically compressing the driving gas, and generating the driving gas having a high temperature; a cold reservoir 60 receiving the high temperature driving gas output from the pulse tube, and adiabatically expanding the driving gas; a second hot heat exchanger 30 installed between the generator 20 and the pulse tube 40, and exchanging heat with the outside; a cold heat exchanger installed between the pulse tube 40 and the cold reservoir 60, and exchanging heat with the outside; and an orifice 62 installed within the cold reservoir, the orifice controlling an amount of the driving gas running between the cold reservoir 60 and the pulse tube 40 to constantly maintain a pressure of the cold reservoir. Here, the driving gas repeats the process of the compression and expansion centering around the pulse tube.

DESCRIPTION OF THE PEPERRED EMBODIMENT

Figure 1:
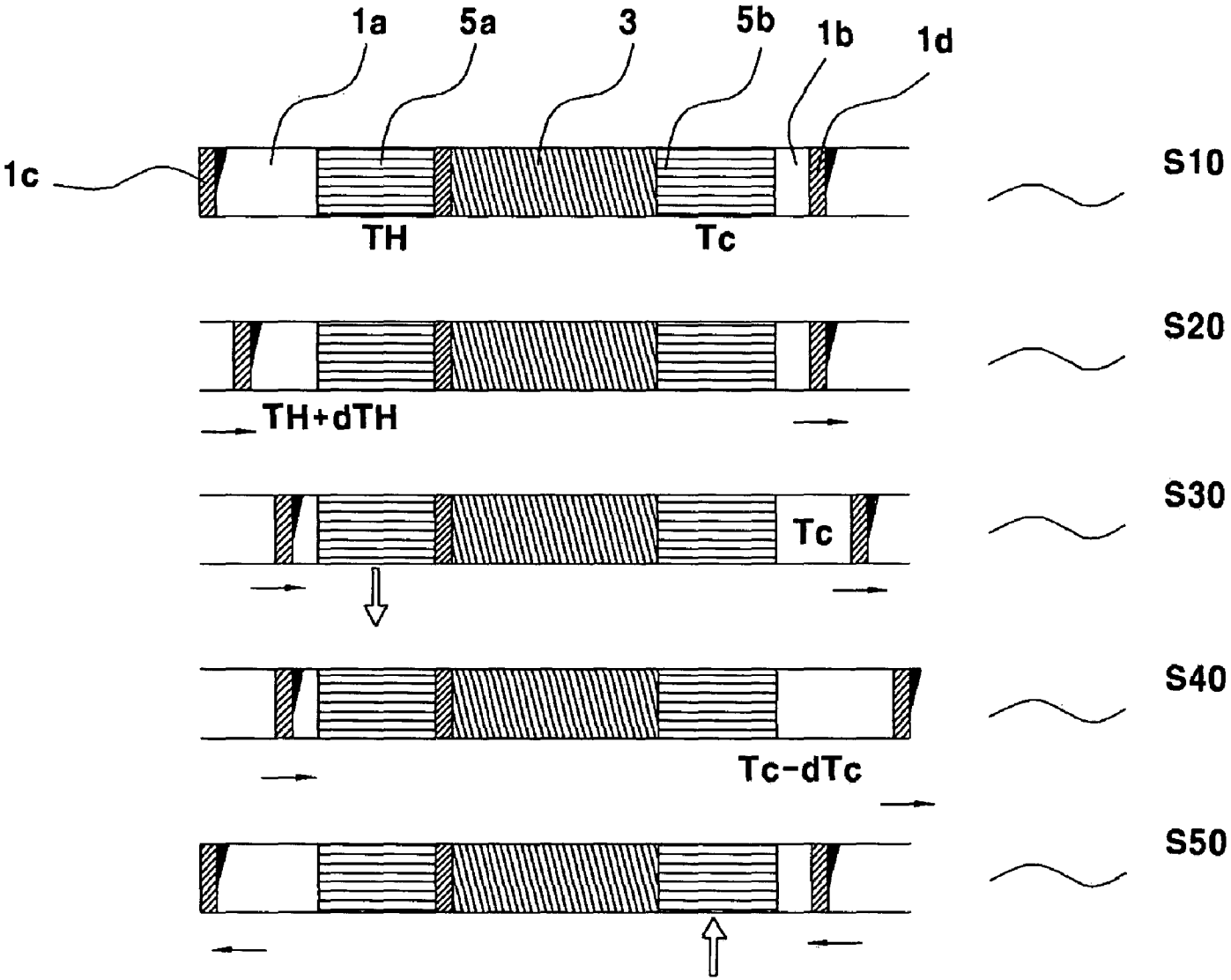
FIG. 1 is a constitutional view for explaining an operation principle of the prior Stirling cryocooler.
Figure 2:
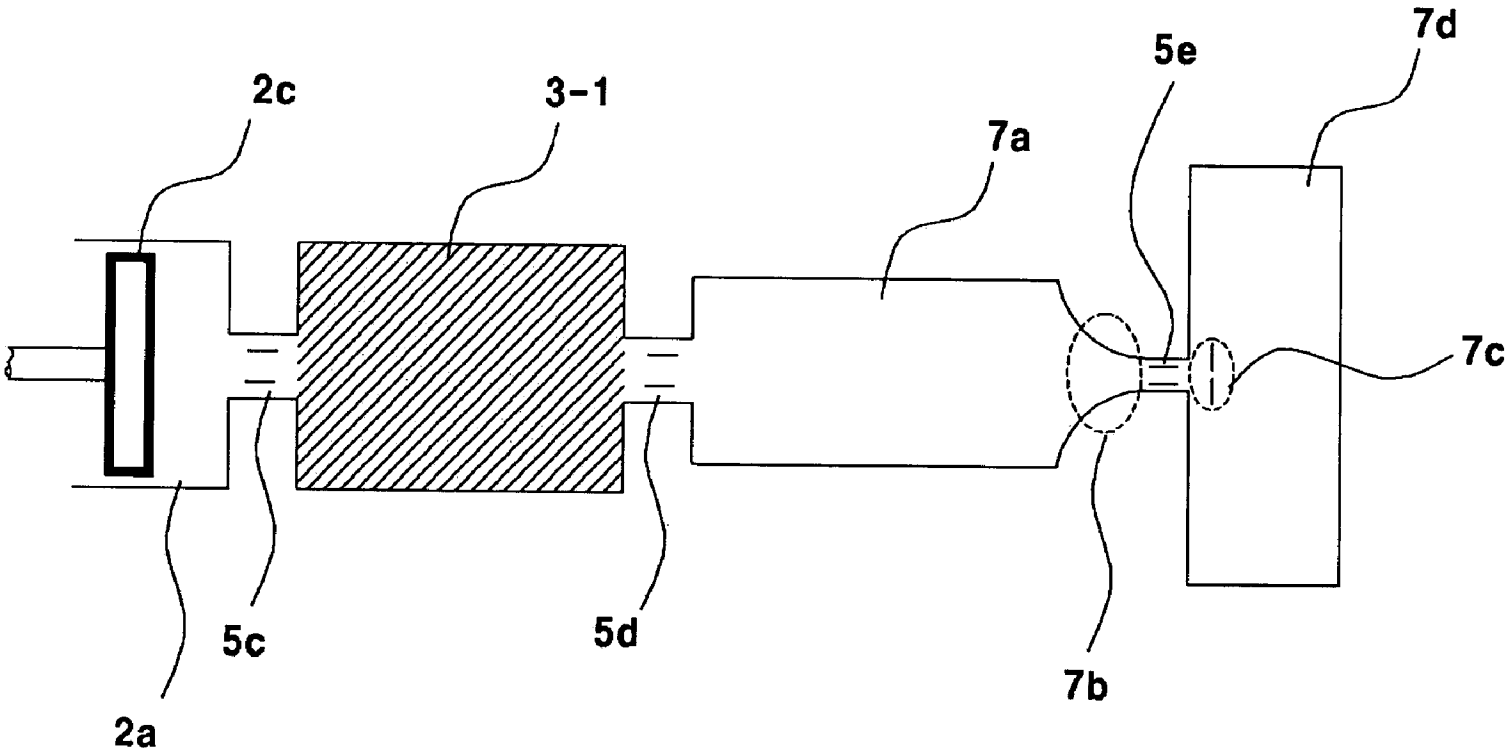
FIG. 2 is a constitutional view of the prior orifice type pulse tube cyrocooler.
Figure 3:
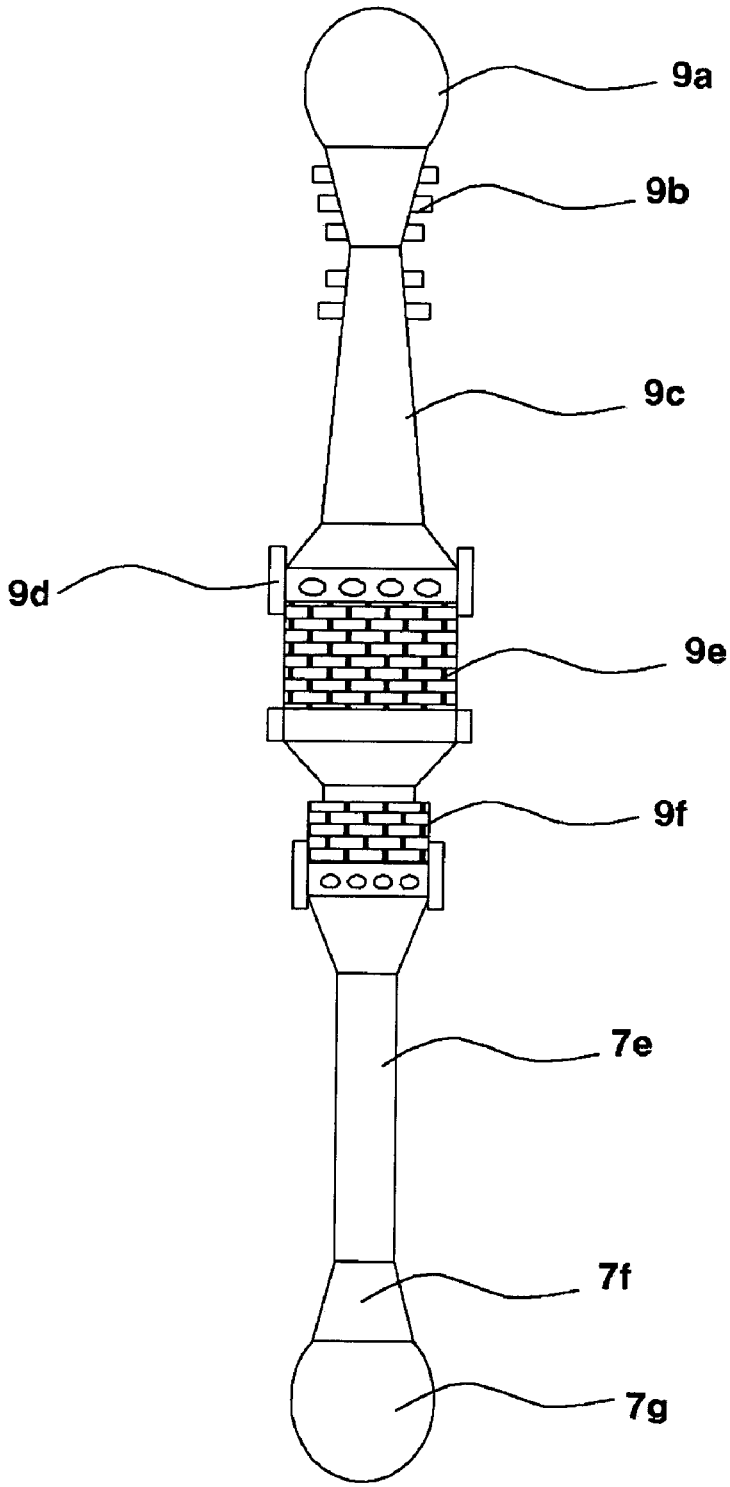
FIG. 3 is a constitutional view of the prior heat driven acoustic pulse tube cryocooler
Figure 4:
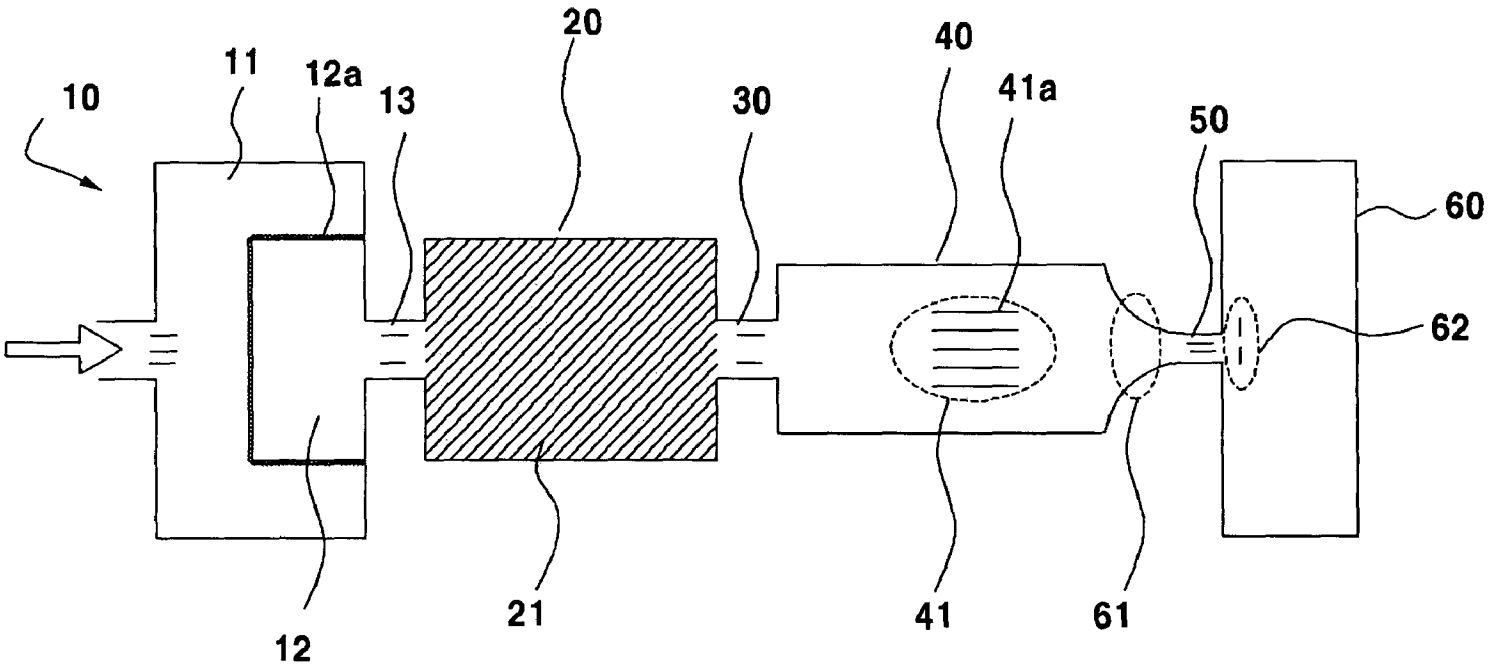
FIG. 4 is a constitutional view of a heat driven acoustic orifice type pulse tube cryocooler according to the invention.
Figure 5:
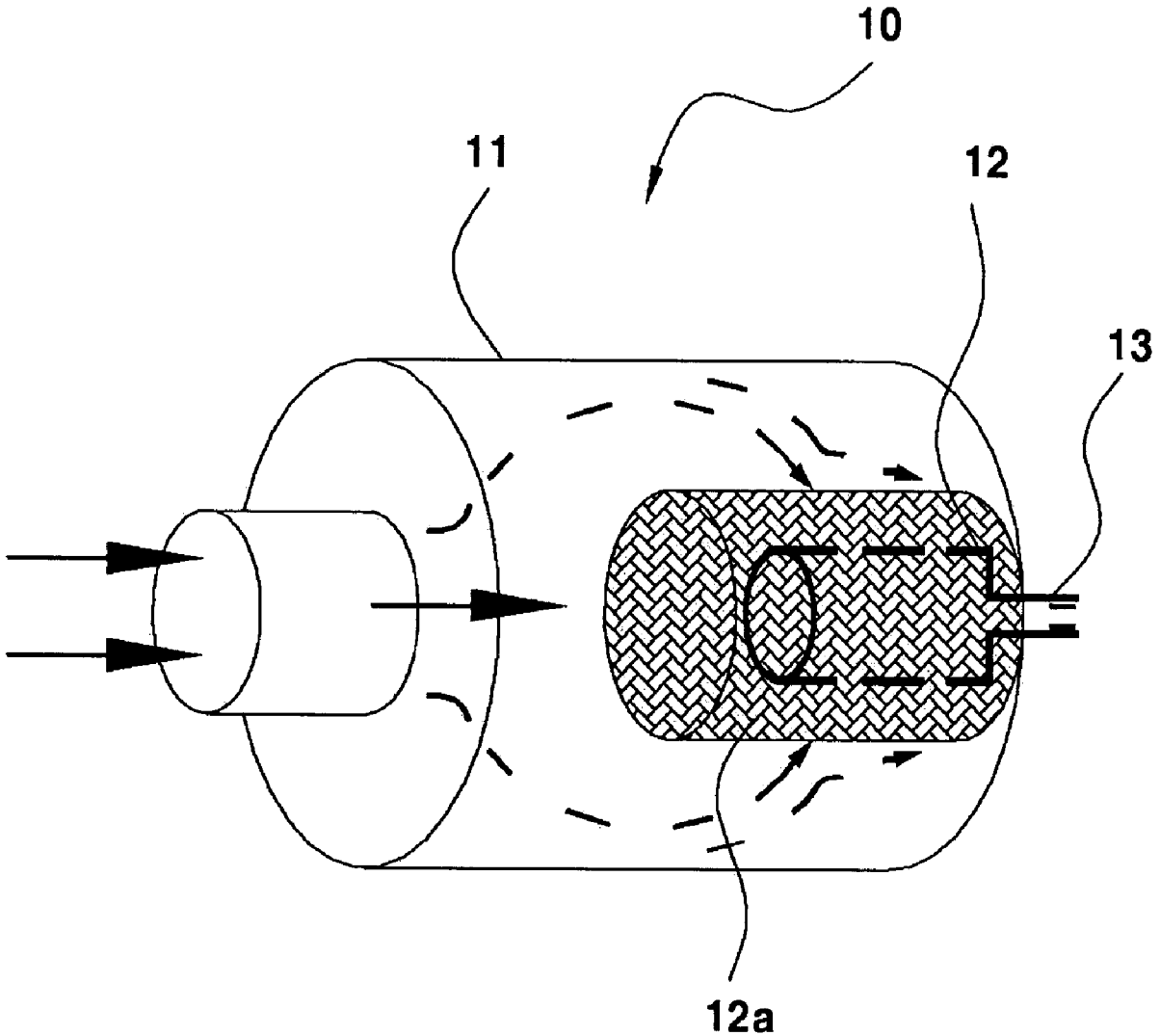
FIG. 5 is a constitutional view for showing specifically a driver in FIG. 4.

FIG. 4 is a constitutional view of a heat driven acoustic orifice type pulse tube cryocooler according to the invention, and FIG. 5 is a constitutional view for showing specifically a driver in FIG. 4.

Referring to FIGS. 4 and 5, a heat driven acoustic orifice type pulse tube cryocooler (hereinafter, referred to "cooler") 100 according to the invention is an apparatus for accomplishing a cooling effect that a very low temperature, preferably about 77K (−196° C.), can be obtained, with an inert gas poured as a driving gas experiencing the process of adiabatic compression and adiabatic expansion to generate a change of the temperature and exchanging with heat the outside, using a vibration energy generated upon changing heat into acoustic.

The cooler 100 comprises a driver 10, as a heating source heating and pulsating the driving gas, changing the temperature of the driving gas by a sound wave generated from the driving gas upon heating and pulsating the driving gas by way of a premixed combustion, a regenerator 20 connected to the driver 10 by a post treatment heat exchanger 13, a second hot heat exchanger 30 in which the driving gas output from the regenerator exchanges heat with the outside, a pulse tube 40 connected to the regenerator 20 by the second hot heat exchanger 30, a cold heat exchanger 50 in which the driving gas output from the pulse tube exchanges heat with the outside, and the cold gas reservoir 60 connected to the pulse tube 40 by the cold heat exchanger 50.

The driver 10, as shown in FIG. 5, comprises a burner 11 into which a mixed gas (e.g. fuel and air) from the outside is input, a first hot heat exchanger 12 installed within the burner 11, and having the driving gas, a metal knit 12*a* surrounding the outer surface of the first hot heat exchanger 12 and installed at a predetermined distance from the inner wall surface of the burner 11 in order to homogeneously heat the driving gas, and a post treatment heat exchanger 13 mounted within the first hot heat exchanger 12 and exposed out of the burner 11 to be connected with the regenerator 20 to control a heat capacity transferred to the outside and the driving gas by way of heat transfer.

Here, preferably, the first hot heat exchanger 12 has a cylindrical shape.

The regenerator 20 has a structure that a plurality of plate 21 is piled up therein.

The pulse tube 40 includes a stack 41 having thin plates 41*a* piled up parallel to the flowing direction of the driving gas, and a diffuser 61 connected to the cold reservoir 60 via the cold heat exchanger 50.

The connection portion between the diffuser 61 and the cold gas reservoir 60 is provided with an orifice 60 within the cold gas reservoir 60. The orifice 62 serves to constantly maintain the pressure of the cold reservoir by controlling the amount of the driving gas reciprocating between the cold gas reservoir 60 and the pulse tube 40.

The driving gas is an inert gas, such as He or Ar. The driving gas is vibrated spontaneously if the driver 10 is heated, and then the pressure wave is generated. The pressure wave causes the driving gas to move in sequence of the post treatment heat exchanger 13, the regenerator 20, the second hot heat exchanger 30, and the pulse tube 40.

Here, the driver 10 heats the driving gas by generating a flame therein. If the driver generates the flame having the temperature of about 1000□ or more by way of premixed combustion to heat the driving gas, the driving gas within the first hot heat exchanger 12 generates the sound wave having the pressure of about 7,600 mmHg and the frequency of about 500 Hz.

Meanwhile, the metal knit 12*a* is a heat transferring member manufactured with metal fiber. The flame generated by way of premixed combustion within the driver 10 contacts directly the surface of the metal knit 12*a*, and then the surface of the first hot heat exchanger 12 is wholly and evenly heated. Thus, the time taken for heating the first hot heat exchanger 12 by the flame is saved. Since the metal fiber heats the surface of the first hot heat exchanger 12 by the latent heat, the metal knit realizes a heat transfer quantity of about 70% through the radiation. The following "Table 1" shows the component parts and the content per weight % of the metal knit 12.

TABLE 1

| Components | Content |
|---|---|
| Cr | 20.00 weight % |
| Al | 5.00 weight % |

TABLE 1-continued

| Components | Content |
|---|---|
| Y | 0.10 weight % |
| Si | 0.30 weight % |
| Mn | 0.08 weight % |
| Cu | 0.03 weight % |
| C | 0.03 weight % |
| Fe | 74.46 weight % |

Figure 6:
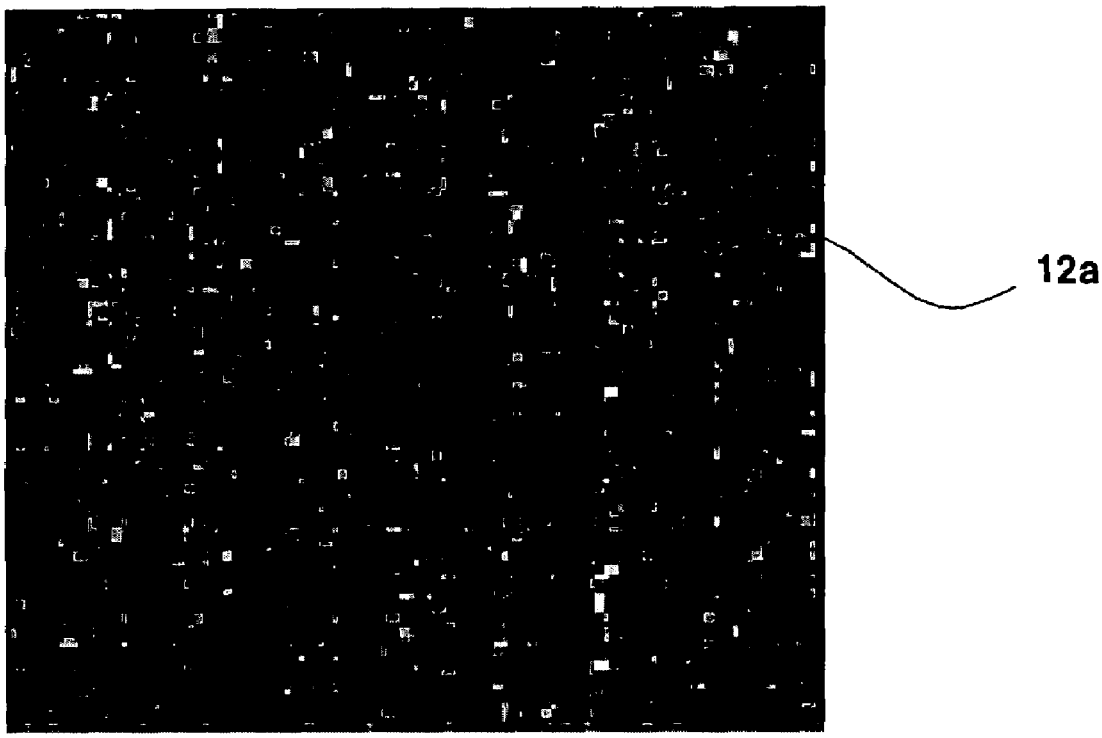
FIG. 6 is a photograph enlarging a surface of a structure of a metal knit according to the invention.

The metal knit 12*a* according to the embodiment of the invention is woven, and then attached the surface of the first hot heat exchanger 12. The shape of the metal knit 12*a* is shown in FIG. 6.

The regenerator 20 causes the driving gas to exchange heat with the outside in the second hot heat exchanger 30 and the cold heat exchanger 50 in turn with the operating gas, which is input to the pulse tube 40 and passes through the second hot heat exchanger 30 after the driving gas having a predetermined frequency band from the driver 11 is input to the inside of the regenerator 20, running between the regenerator 20 and the cold gas reservoir 60.

One side of stack 41 of the pulse tube 40 contacts with a driving gas having a comparatively lower temperature, and the other side of stack 41 contacts with a driving gas having a comparatively higher temperature. Thus, the one side of the stack 41 retains a heat of a comparatively lower temperature, and the other side of the stack 41 retains a heat of a comparatively higher temperature Here, an inner pressure of the cold gas reservoir 60 is always constant.

The operation of the cooler 100 according to the invention will be given herein below.

For example, if a flame having a temperature of about 1000° C. generated from the burner 11 of the driver 10 is applied to the metal knit 12*a*, the flame is homogeneously transferred to the driving gas within the first hot heat exchanger 12 by way of radiation. Then, the driving gas is vibrated by the sound wave having the pressure of about 7,600 mmHg and the frequency of about 500 Hz, and then the temperature of the driving gas is raised through the adiabatic compression process due to the above vibration.

The driving gas having the raised temperature transfer heat passing through the regenerator 20, and then is cooled to the gas of low temperature. At this time, the temperature of the cold gas becomes about 77K. Then, the driving gas of the low temperature is reached to the second hot heat exchanger 30, and exchanges heat with the outside.

Then, the driving gas is heated passing through the stack 41 of the pulse tube 40 to have a high temperature, and then moved to orifice 62. During this process, the cold heat exchanger 50 exchanges heat with the outside.

The temperature of the driving gas flowed in the cold gas reservoir 60 via the orifice 62 is lower due to the adiabatic expansion. At this time, the above temperature is lower than that of the cold heat exchanger 50. The driving gas with the lower temperature is moved again to the cold heat exchanger 50, and then receives heat from the outside.

Then, the driving gas come from the cold heat exchanger 50 flows in the regenerator 20 passing through the pulse tube 40, and then receives heat. The heated driving gas is moved again from the regenerator 20 to the second hot heat exchanger 30. At this time, the heat transfer quantity which the driving gas receives from the regenerator 20 while the driving gas passes from the second hot heat exchanger 30 to the regenerator 20 is equal to the heat transfer quantity which the driving gas transfers to the regenerator 20 while the driving gas passes from to the regenerator 20 to the second hot heat exchanger 30 in the prior process. Therefore, a sum of the exchanged heat capacity per one cycle is numerically "0".

On the whole, the driving gas runs between the second hot heat exchanger 30 and the cold heat exchanger 50 with existing in the status of the low temperature at one side of the stack 41, whereas existing in the status of the high temperature at the other side of the stack 41, centering around the stack 41 of the pulse tube 40. Since the pulse tube is operated by the virtual gas piston, the driving gas repeats the process of the compression and expansion centering around the pulse tube Therefore, the cooler according to the invention realizes the cooing principle that the heat from the low temperature side is emitted to the high temperature side with experiencing the above subsequent process.

FIG. 6 is a photograph enlarging a surface of a structure of a metal knit according to the invention.

The metal knit 12*a* is attached to the surface of the first hot heat exchanger 12 of the driver 12*a*. The metal knit 12*a* radiates heat of the flame generated from the burner 11, and then homogeneously transfers the heat to the driving gas within the first hot heat exchanger 12.

At this time, the metal knit 12*a* is manufactured in the form of knit woven with the metal fiber of a plurality of strands, which is comparatively thin, but has a constant thickness. Thus, if the metal knit 12*a* is heated by the flame with covered to adhere closely to the surface of the first hot heat exchanger 12, the heat is homogeneously transferred to the whole surface of the first hot heat exchanger 12.

Further, since the metal knit 12*a* serves to comparatively enlarge the area of the first hot heat exchanger 12 contacted by the flame, it causes comparatively a quantity of heat to transfer to the first hot heat exchanger 12. Thus, the length of the flame generated from the burner 11 can be reduced up to about 20 cm.

Though the inert gas such as He or Ar is illustrated as the driving gas in the embodiment of the invention, Ne or Xe except for the above inert gas, or a gas of mixing the inert gases may be used.

Further, though the metal knit 12*a* woven with the metal fiber is illustrated to enclose the surface of the first hot heat exchanger 12, a plurality of strands of metal fiber may be evenly attached to the surface of the first hot heat exchanger 12.

Further, the metal fiber having a variety of shape may be manufactured by changing the content value of the component parts.

From the foregoing, a heat driven acoustic orifice type pulse tube cryocooler according to the invention can be efficiently utilized in a superconductivity application device for requiring a small capacity and for a superconductivity electronic equipments, such as a field of infrared rays sensor cooling, a field of cryooperating and MRI, a field of electronic equipments such as RF filter for mobile communication, and a filed of a superconductivity electric power application device.

Further, according to the inventive cryocooler, since the driver can be driven as a single element, and the metal fiber of the driver cause the length of the flame to be reduced from about 150 cm in the prior art to about 20 cm, the vibration and noise is not only considerable reduced, but also the operation reliability and efficiency is higher and the cooling capacity is larger.

What is claimed is:

1. A heat driven acoustic orifice type pulse tube cryocooler comprising:

a driver (10) generating a flame radiating heat having a predetermined temperature, homogeneously heating a driving gas, and adiabatically compressing the driving gas so that the driving gas generates an acoustic having a predetermined frequency;

a regenerator (20) receiving the driving gas output from the driver, and cooling the driving gas;

a pulse tube (30) receiving the cold driving gas output from the regenerator, adiabatically compressing the driving gas, and generating the driving gas having a high temperature;

a cold reservoir (60) receiving the high temperature driving gas output from the pulse tube, and adiabatically expanding the driving gas;

a first hot heat exchanger (30) installed between the generator (20) and the pulse tube (40), and exchanging heat with the outside;

a cold heat exchanger installed between the pulse tube (40) and the cold reservoir (60), and exchanging heat with the outside; and an orifice (62) installed within the cold reservoir, the orifice controlling an amount of the driving gas running between the cold reservoir (60) and the pulse tube (40) to constantly maintain a pressure of the cold reservoir;

wherein the driving gas repeats the process of the compression and expansion centering around the pulse tube.

2. The cyrocooler according to claim 1, wherein the driver includes a burner (11) into which a mixed gas from the outside is input, a second hot heat exchanger (12) installed within the burner (11), and having the driving gas, a heat transferring member (12*a*) surrounding the outer surface of the second hot heat exchanger (12) and installed at a predetermined distance from the inner wall surface of the burner (11) in order to homogeneously heat the driving gas, and a post treatment heat exchanger (13) mounted within the second hot heat exchanger (12) and exposed out of the burner (11) to be connected with the regenerator (20), the heat exchanger (13) controlling a heat capacity transferred to the outside and the driving gas.

3. The cyrocooler according to claim 2, wherein the mixed gas is a gas mixed with a fuel and an air.

4. The cyrocooler according to claim 2, wherein the second hot heat exchanger has a cylindrical shape.

5. The cyrocooler according to claim 2, wherein the heat transferring member has a metal knit shape formed weaving a metal fiber.

6. The cyrocooler according to claim 5, wherein the metal fiber includes a 20.00% weight of Cr, a 5.00% weight of Al, a 0.10% weight of Y, a 0.30% weight of Si, 0.08% weight of Mn, 0.03% weight of Cu, 0.03% weight of C, and a 74.46% weight of Fe.

7. The cyrocooler according to claim 2, wherein the pulse tube includes a stack (41) having thin plates (41*a*) piled up parallel to the flowing direction of the driving gas, and a diffuser connected to the cold reservoir (60) via the cold heat exchanger (50), the orifice being installed in the connection portion of the cold reservoir.

8. The cyrocooler according to claim 2, wherein the driving gas is an inert gas.

9. The cyrocooler according to claim 2, wherein the pulse tube includes a stack (41) having thin plates (41*a*) piled up parallel to the flowing direction of the driving gas, and a diffuser connected to the cold reservoir (60) via the cold heat exchanger (50), the orifice being installed in the connection portion of the cold reservoir.

10. The cyrocooler according to claim 1, wherein the driving gas is an inert gas.

11. The cyrocooler according to claim 1, wherein the pulse tube includes a stack (41) having thin plates (41*a*) piled up parallel to the flowing direction of the driving gas, and a diffuser connected to the cold reservoir (60) via the cold heat exchanger (50), the orifice being installed in the connection portion of the cold reservoir.

* * * * *